US007537483B2

(12) United States Patent
Lin et al.

(10) Patent No.: US 7,537,483 B2
(45) Date of Patent: May 26, 2009

(54) MICRO USB PLUG

(75) Inventors: Chih-Ming Lin, Taichung (TW); Chin-Tsai Shih, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 12/163,157

(22) Filed: Jun. 27, 2008

(65) Prior Publication Data

US 2009/0088025 A1 Apr. 2, 2009

(30) Foreign Application Priority Data

Sep. 28, 2007 (TW) ..... 96136209 A

(51) Int. Cl.
*H01R 13/648* (2006.01)

(52) U.S. Cl. ..... 439/607

(58) Field of Classification Search ..... 439/607–610, 439/660, 595, 353, 296, 345, 350, 680, 488–489
See application file for complete search history.

(56) References Cited

U.S. PATENT DOCUMENTS 7,033,218 B2 * 4/2006 Huang et al. ..... 439/607
7,198,522 B1 * 4/2007 Ho et al. ..... 439/660
2006/0228946 A1 * 10/2006 Chung ..... 439/607

* cited by examiner

*Primary Examiner*—Edwin A. Leon
(74) *Attorney, Agent, or Firm*—Darby & Darby P.C.

(57) ABSTRACT

A micro USB plug includes a terminal seat and a terminal unit including two first terminals, two second terminals, and a third terminal. Each of the first, second, and third terminals extends into the terminal seat and has an extending segment formed with a contact projection, an inspection segment connected to the extending segment and having an inspection surface that is flush with a reference surface of the terminal seat and an abutting surface that abuts against the terminal seat, and a soldering segment extending from the inspection segment. The contact projections and the inspection segments of the first and third terminals extend in a same direction. The contact projections and the inspection segments of the second terminals extend in opposite directions. A segment length of the soldering segments of the first terminals differs from that of the soldering segment of the third terminal.

17 Claims, 16 Drawing Sheets

MICRO USB PLUG

CROSS-REFERENCE TO RELATED APPLICATION

This application claims priority of Taiwanese Application No. 096136209, filed on Sep. 28, 2007.

BACKGROUND OF THE INVENTION

1. Field of the Invention

The invention relates to a Universal Serial Bus (USB) plug, more particularly to a micro USB plug.

2. Description of the Related Art

Portable electronic products, such as a mobile phone, a personal digital assistant (PDA), a digital camera, or the like, have a trend toward small size and light weight. The smallest USB plug that is currently available, i.e., the mini USB plug, is still too large and does not meet requirements in some small portable electronic products.

SUMMARY OF THE INVENTION

Therefore, an object of the present invention is to provide a USB plug that is easy to assemble and that has a relatively small size.

Accordingly, a micro USB plug of the present invention comprises a terminal seat having a reference surface and a terminal unit including two first terminals, two second terminals, and a third terminal. Each of the first, second, and third terminals extends into the terminal seat parallel to a first axis that is normal to the reference surface, and has an extending segment, an inspection segment, and a soldering segment. The extending segment extends parallel to the first axis and has one end formed with a contact projection. The inspection segment is connected to the other end of the extending segment opposite to said one end and extends parallel to a second axis transverse to the first axis. The inspection segment has an inspection surface flush with the reference surface of the terminal seat, an abutting surface opposite to the inspection surface in a direction parallel to the first axis and abutting against the terminal seat, and a distal end spaced apart from the extending segment in a direction parallel to the second axis. The soldering segment extends from the distal end of the inspection segment parallel to the first axis and toward said one end of the extending segment, and has a segment length. The contact projection of each of the first and third terminals projects in the same direction as the inspection segment of said one of the first and third terminals. The contact projection of each of the second terminals projects in a direction opposite to that in which the inspection segment of said one of the second terminals extends.

The segment length of the soldering segment of each of the first terminals is not equal to that of the soldering segment of the third terminal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
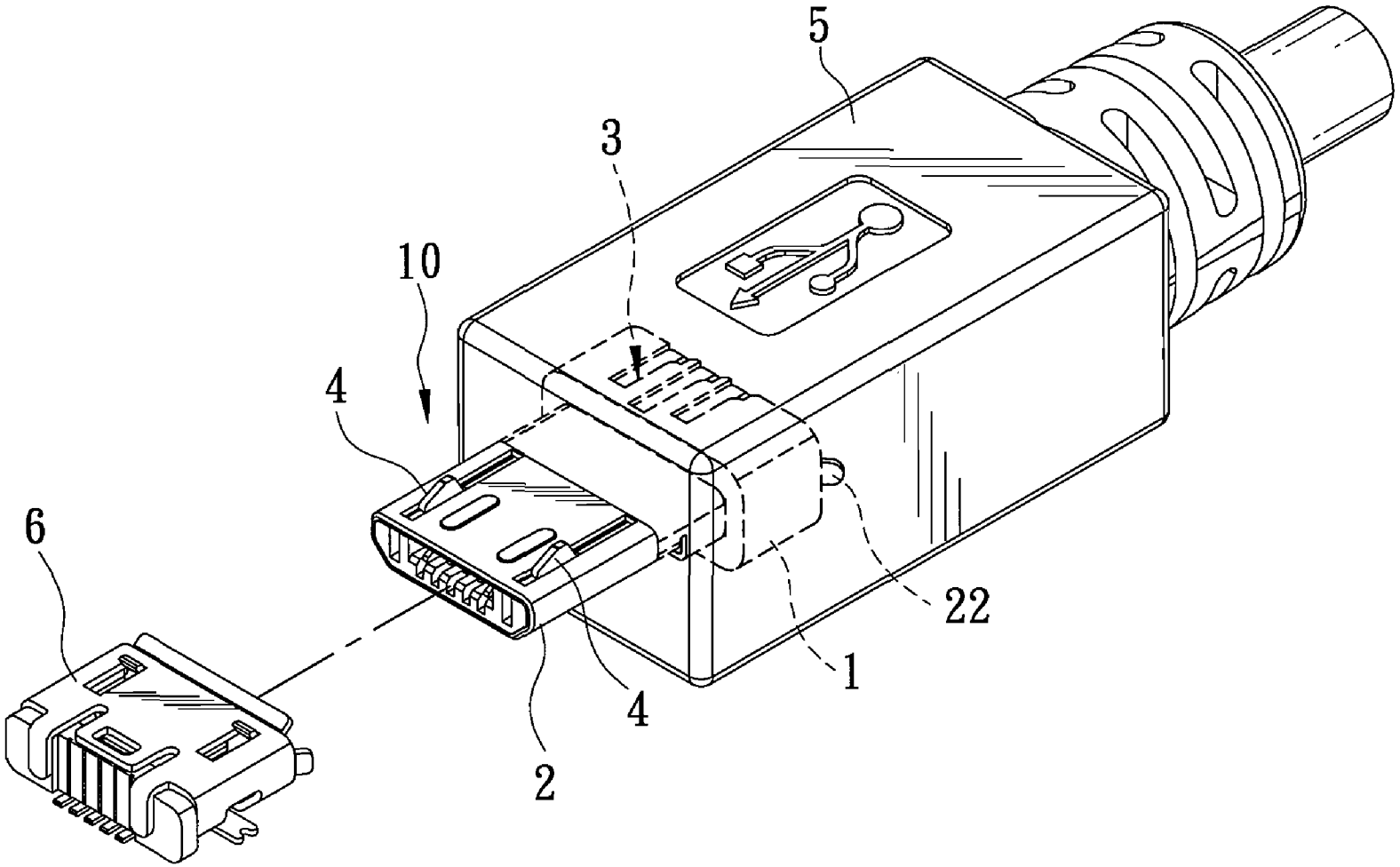
FIG. 1 is a perspective view of a micro USB connector unit including a preferred embodiment of a micro USB plug according to the invention.

As shown in FIG. 1, the preferred embodiment of a micro USB plug 10 according to the present invention is adapted to form a part of a micro USB connector unit, and is adapted to be connected electrically to a micro USB receptacle 6 of the micro USB connector unit. The micro USB plug 10 comprises a terminal seat 1, a housing 2, a terminal unit 3, and a pair of receptacle engaging latches 4.

Figure 2:
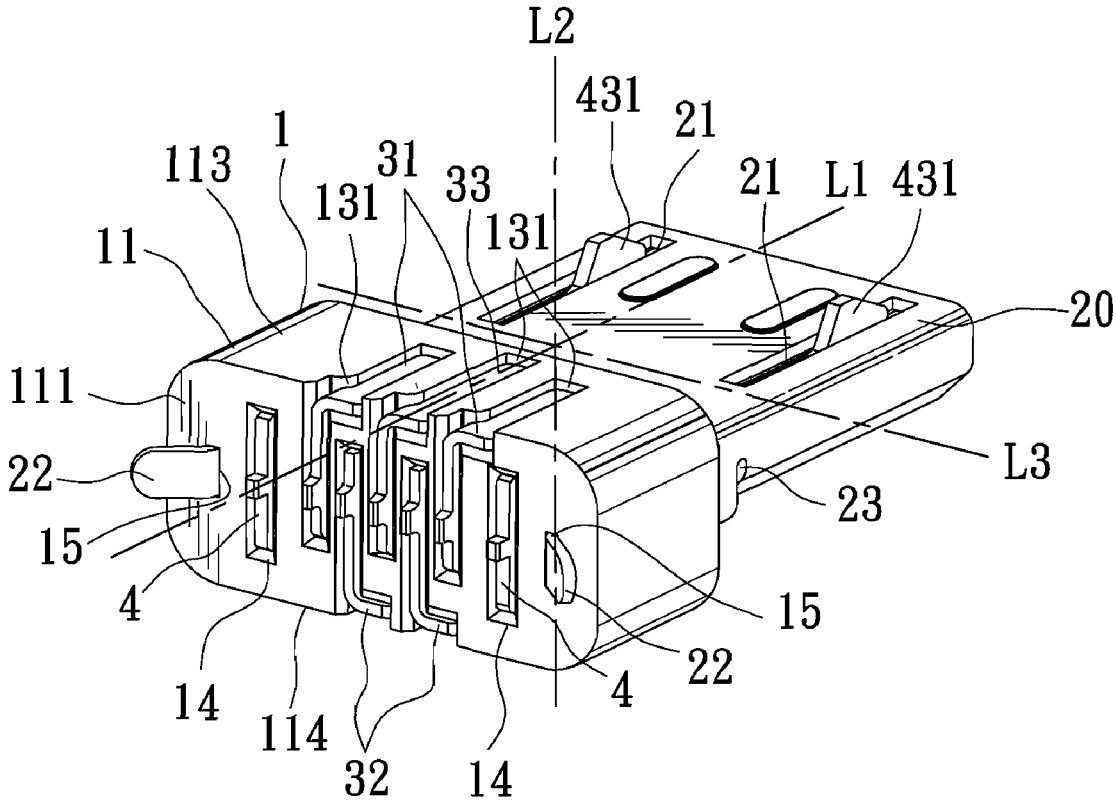
FIG. 2 is an assembled perspective view of the preferred embodiment.
Figure 3:
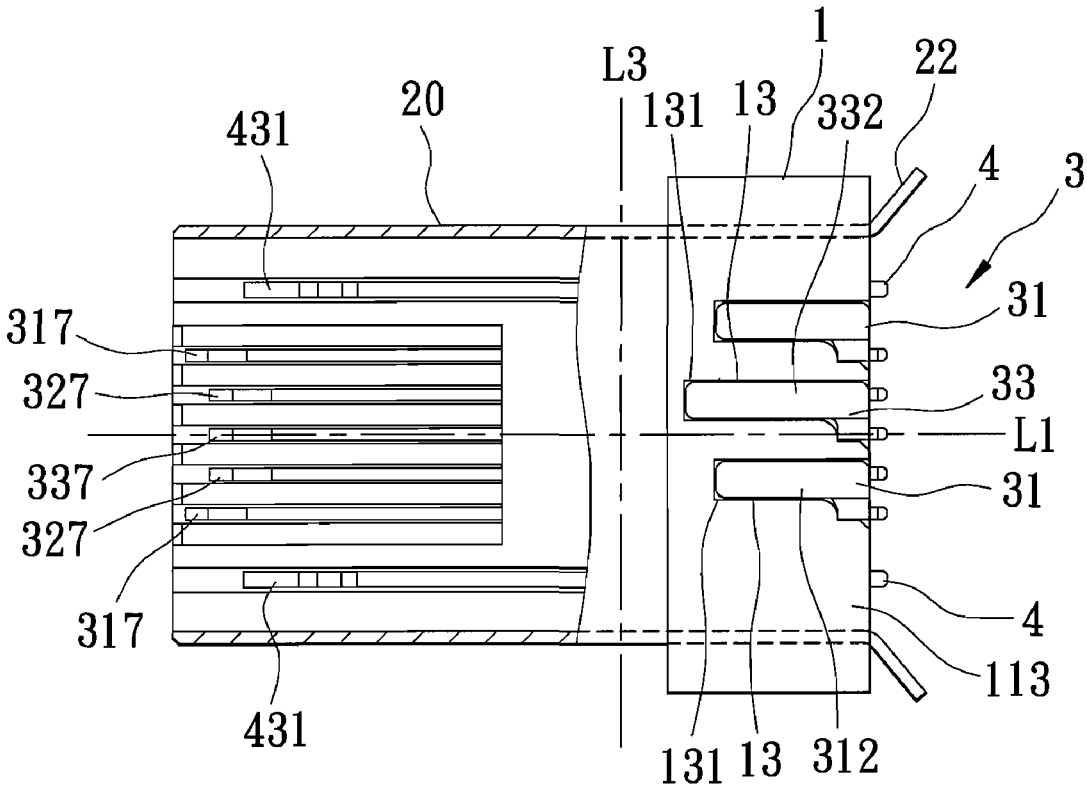
FIG. 3 is a schematic view of the preferred embodiment.
Figure 4:
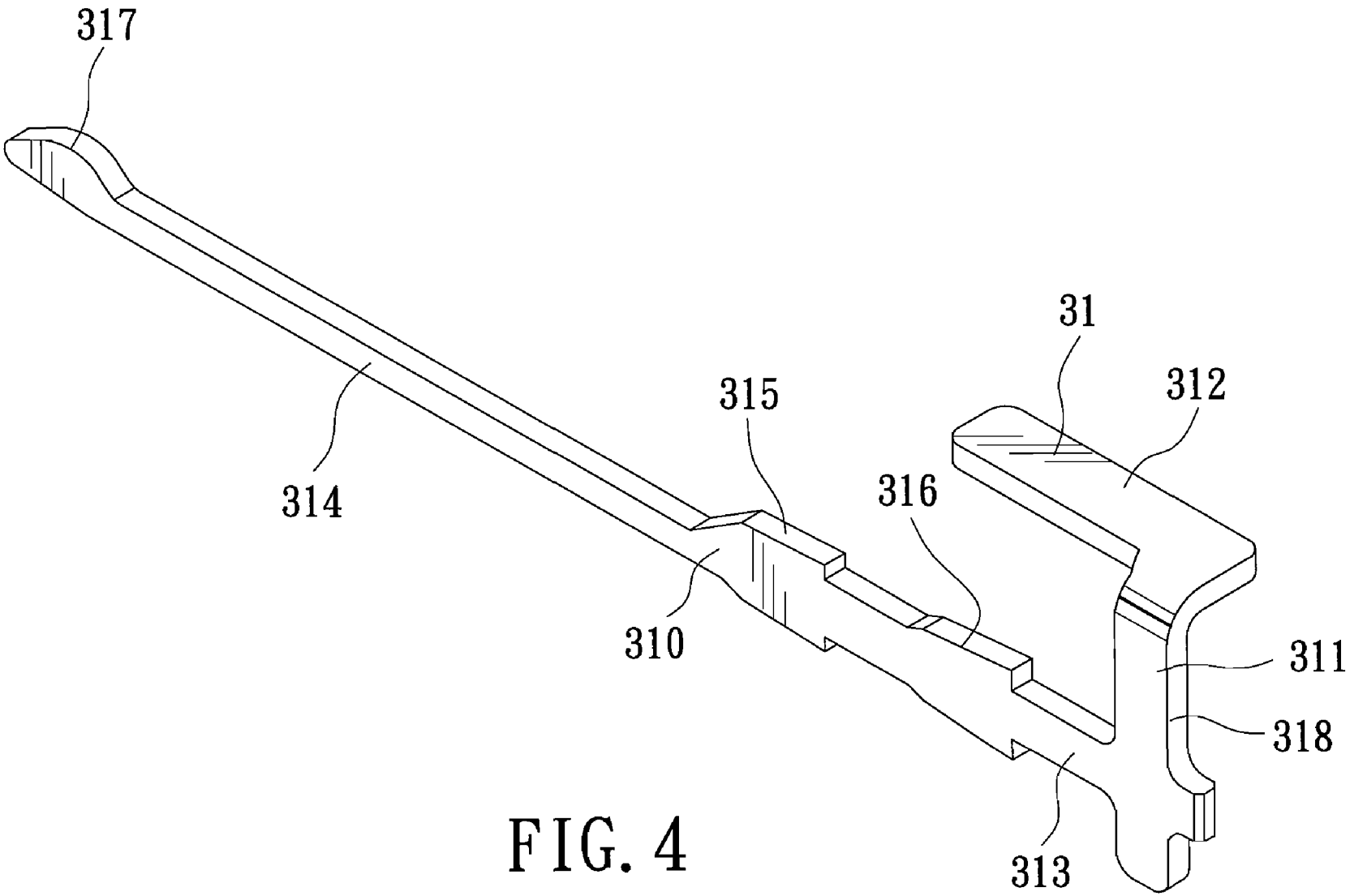
FIG. 4 is a perspective view of a first terminal.
Figure 10:
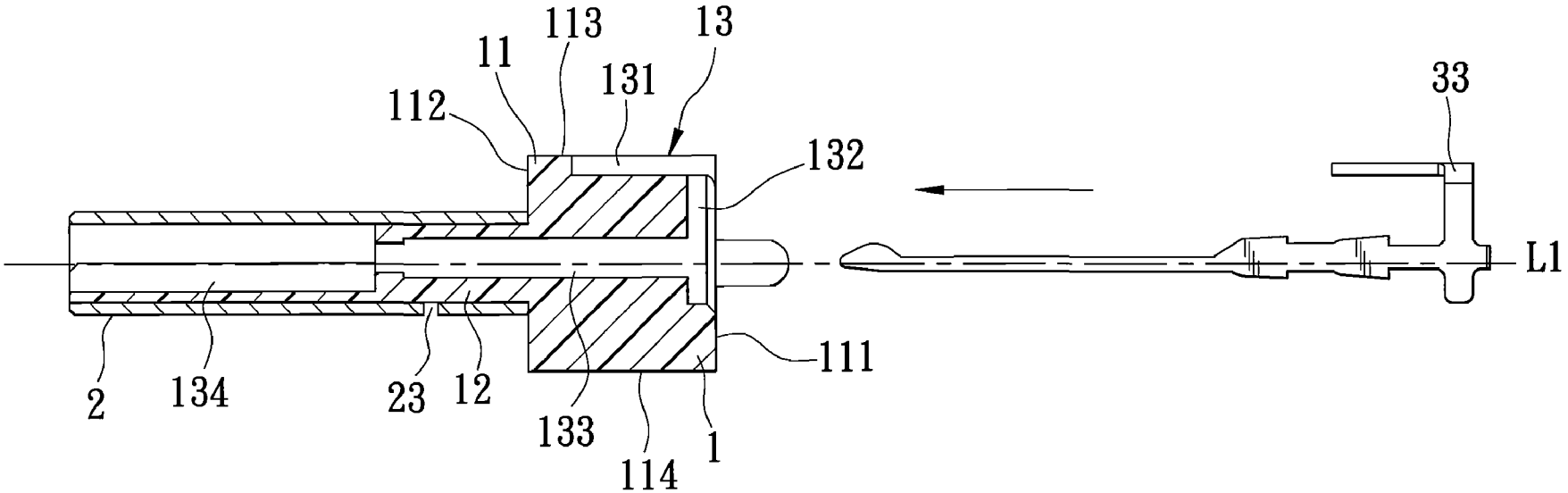
FIG. 10 is a sectional view of the preferred embodiment, illustrating the third terminal before being extended into a terminal seat.
Figure 11:
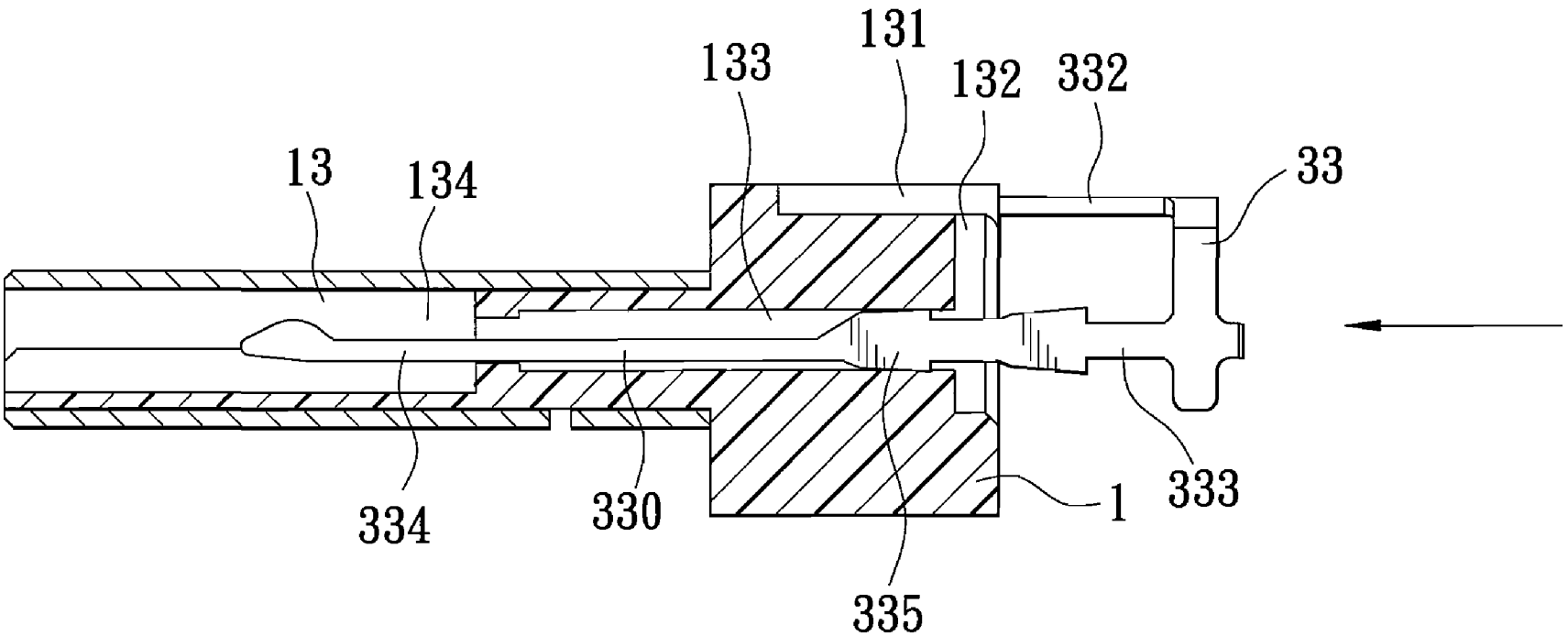
FIG. 11 is another sectional view of the preferred embodiment, illustrating the third terminal when being extended into the terminal seat.
Figure 12:
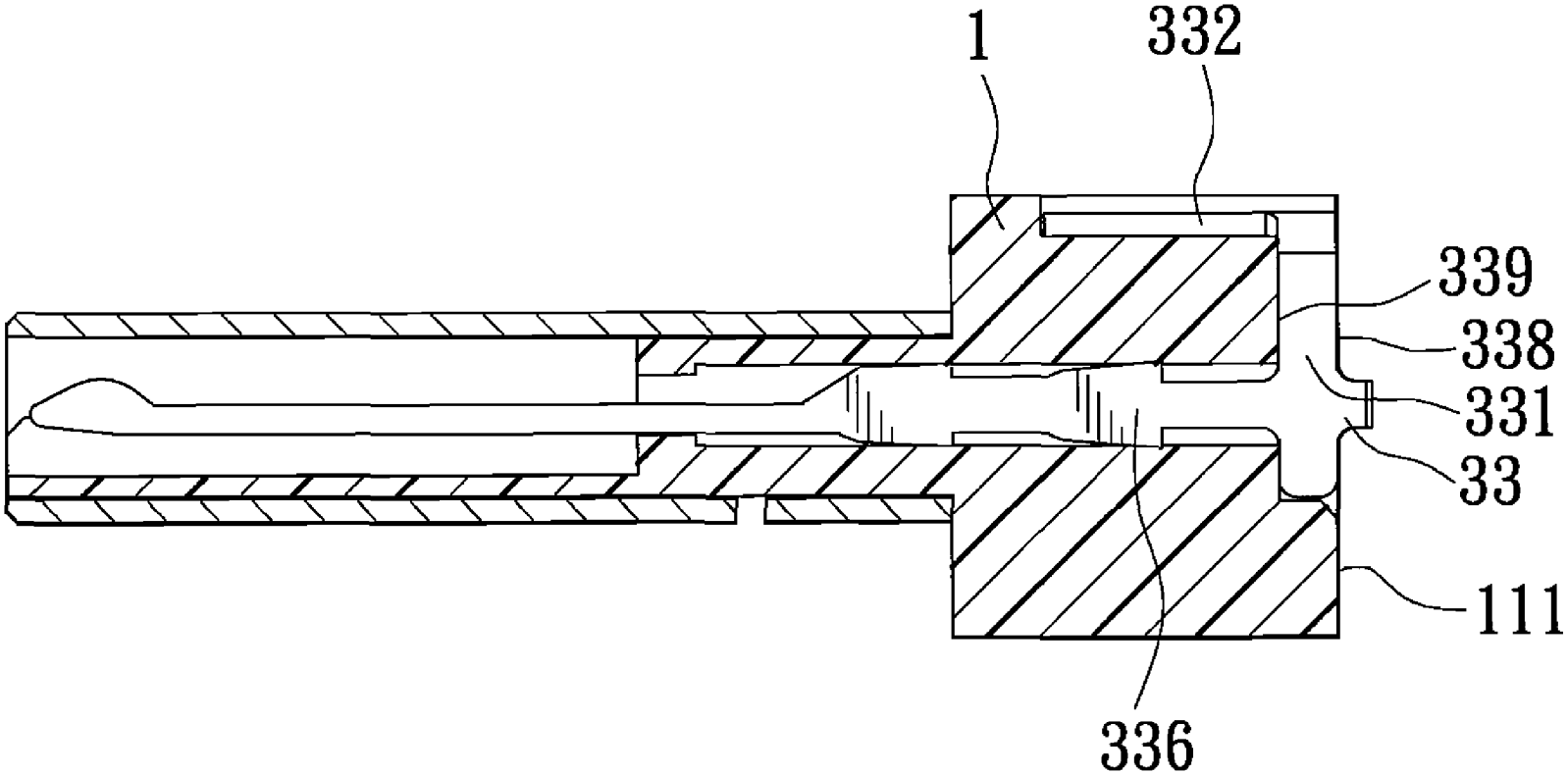
FIG. 12 is a view similar to FIG. 11, but illustrating the third terminal after being extended into the terminal seat.

As further shown in FIGS. 2, 3, and 10, the terminal seat 1 has a positioning section 11 that is formed with a reference surface 111 and an end surface 112 disposed opposite to the reference surface 111 with respect to a first axis (L1) that is normal to the reference and end surfaces 111, 112, a coupling section 12 that extends parallel to the first axis (L1) from the end surface 112 of the positioning section 11, a plurality of terminal spaces 13 that are spaced apart from each other along a third axis (L3) transverse to the first axis (L1), and a pair of latch holes 14. The positioning section 11 has opposite first and second surfaces 113, 114 extending from the reference surface 111 to the end surface 112 in a direction parallel to the first axis (L1), and a pair of anchor holes 15 extending parallel to the first axis (L1) from the reference surface 111 through the end surface 112.

As shown in FIGS. 2 to 7, the terminal unit 3 includes two first terminals 31, two second terminals 32, and a third terminal 33 that extend respectively into the terminal spaces 13 in the terminal seat 1 parallel to the first axis (L1). In this embodiment, the second terminals 32 flank the third terminal 33 with respect to the first axis (L1), and the first terminals 31 flank the second and third terminals 32, 33 with respect to the first axis (L1). Each of the first, second, and third terminals 31, 32, 33 has an extending segment 310, 320, 330 extending parallel to the first axis (L1), an inspection segment 311, 321, 331, and a soldering segment 312, 322, 332. The inspection segment 311, 321, 331 is connected to one end of the extending segment 310, 320, 330, extends parallel to a second axis (L2) transverse to the first axis (L1) and the third axis (L3), and has an inspection surface 318, 328, 338, an abutting surface 319, 329, 339 opposite to the inspection surface 318, 328, 338 in a direction parallel to the first axis (L1) and a distal end 3111, 3211, 3311 spaced apart from the extending segment 310, 320, 330 in a direction parallel to the second axis (L2). The soldering segment 312, 322, 332 extends from the distal end 3111, 3211, 3311 of the inspection segment 318, 328, 338 parallel to the first axis (L1) and toward the other one end of the extending segment 310, 320, 330. The extending segment 310, 320, 330 has an extending section 313, 323, 333 connected to the inspection segment 311, 321, 331, and a resilient section 314, 324, 334 extending from one end of the extending section 313, 323, 333 opposite to the inspection segment 311, 321, 331 and formed with a contact projection 317, 327, 337 at one end distal from the extending section 313, 323, 333. The extending section 313, 323, 333 is formed with a seat engaging portion 316, 326, 336 and a guide portion 315, 325, 335 between the seat engaging portion 316, 326, 336 and the resilient section 314, 324, 334. Both the seat engaging portion 316, 326, 336 and the guide portion 315, 325, 335 taper toward the resilient section 314, 324, 334.

Figure 5:
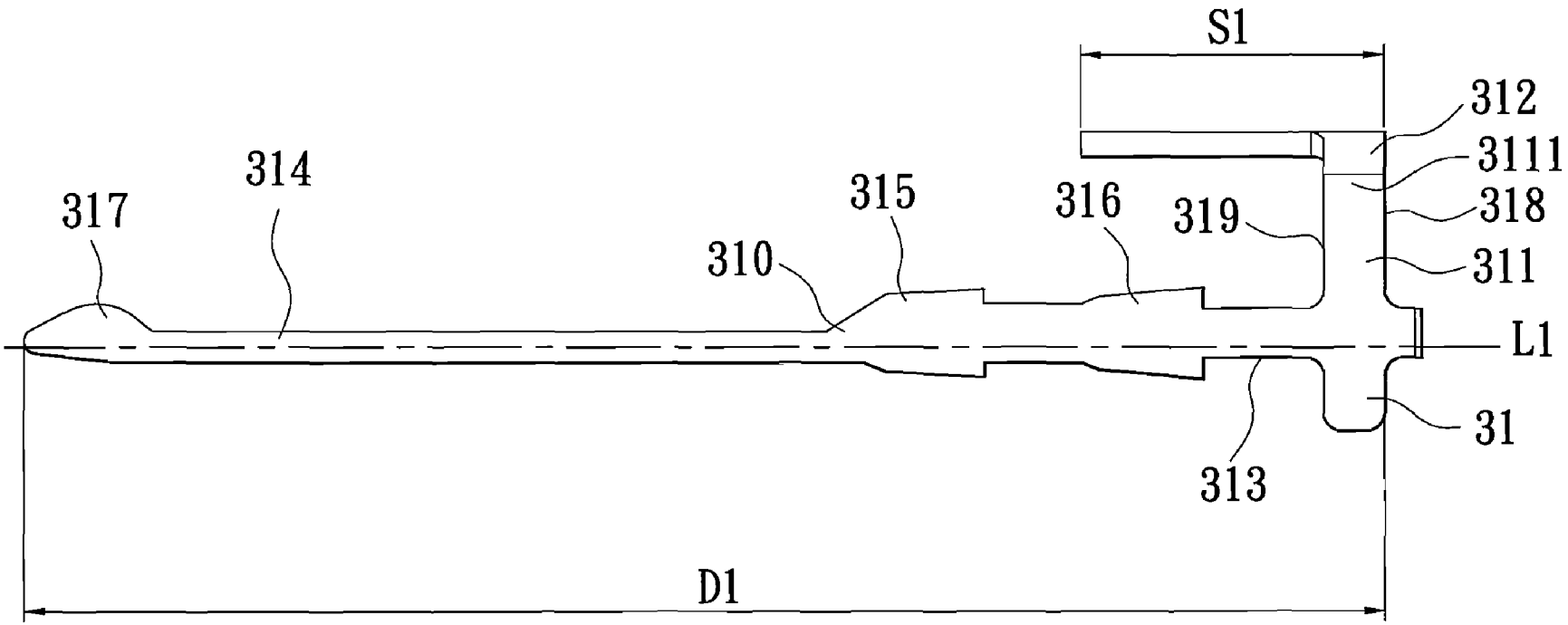
FIG. 5 is a side view of the first terminal.
Figure 6:
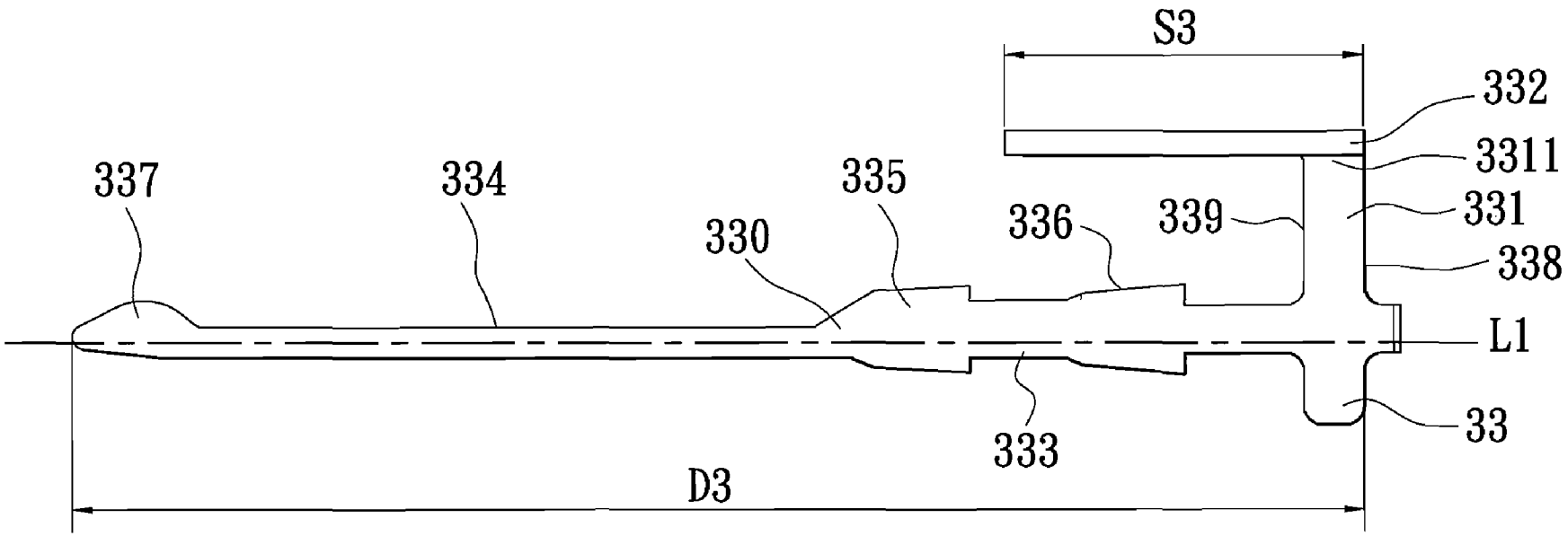
FIG. 6 is a side view of a third terminal.
Figure 7:
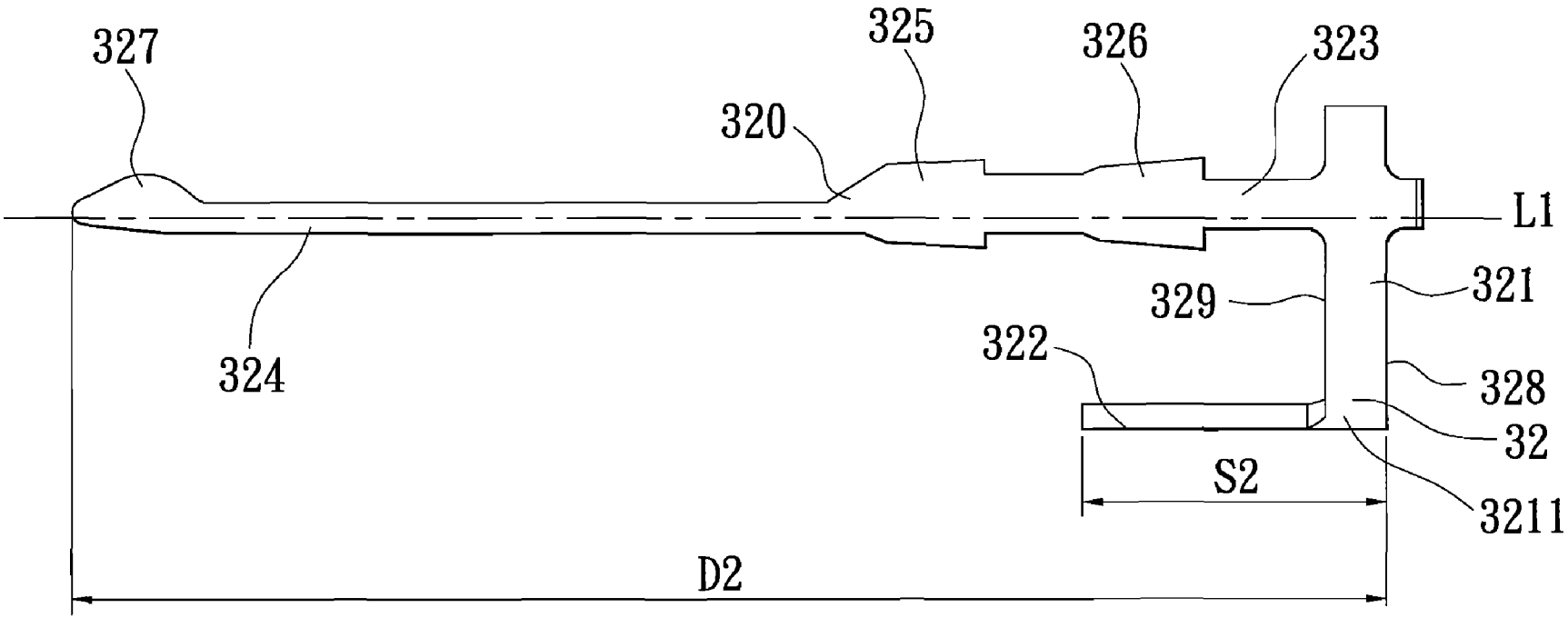
FIG. 7 is a side view of a second terminal.
Figure 8:
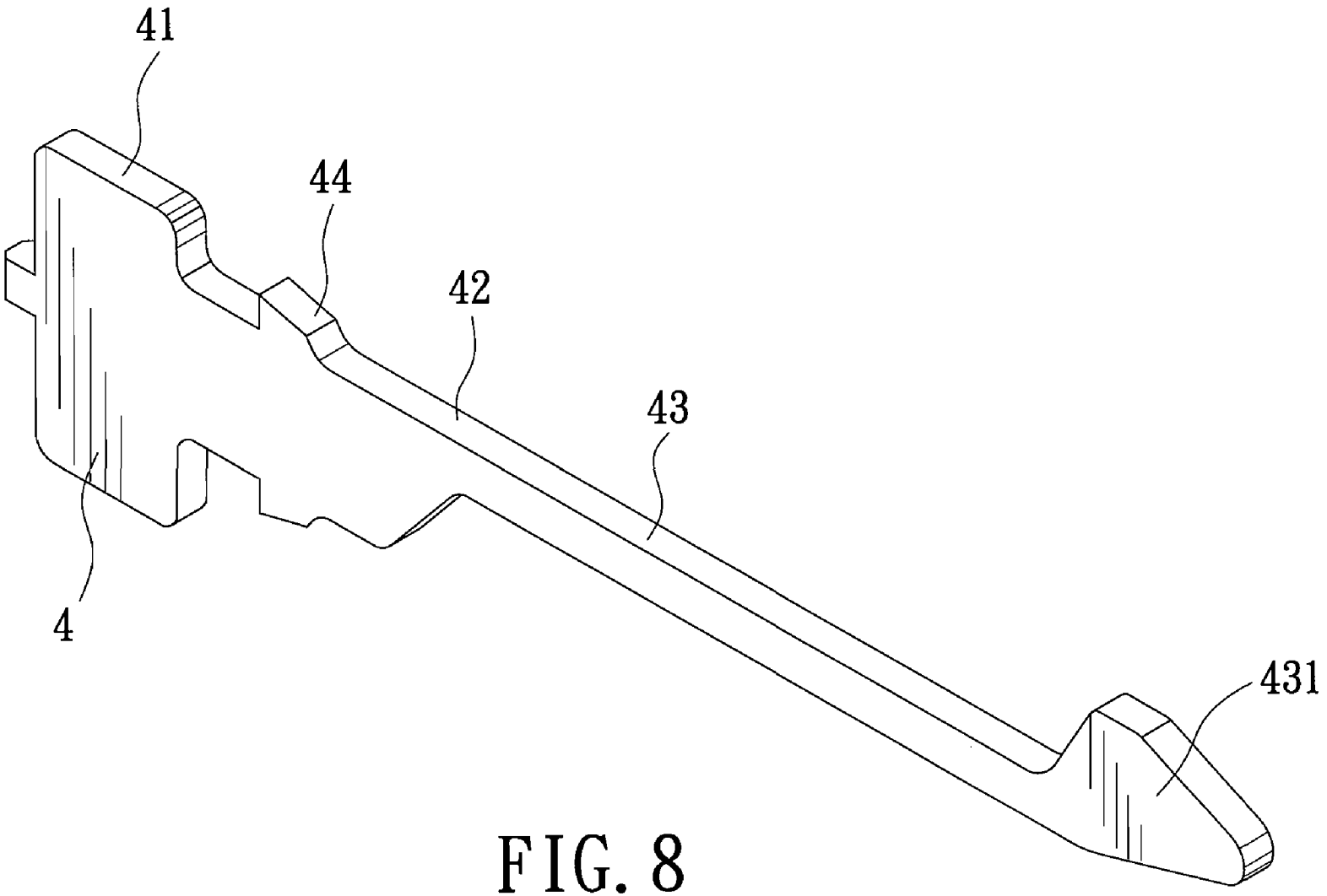
FIG. 8 is a perspective view of a receptacle engaging latch.
Figure 9:
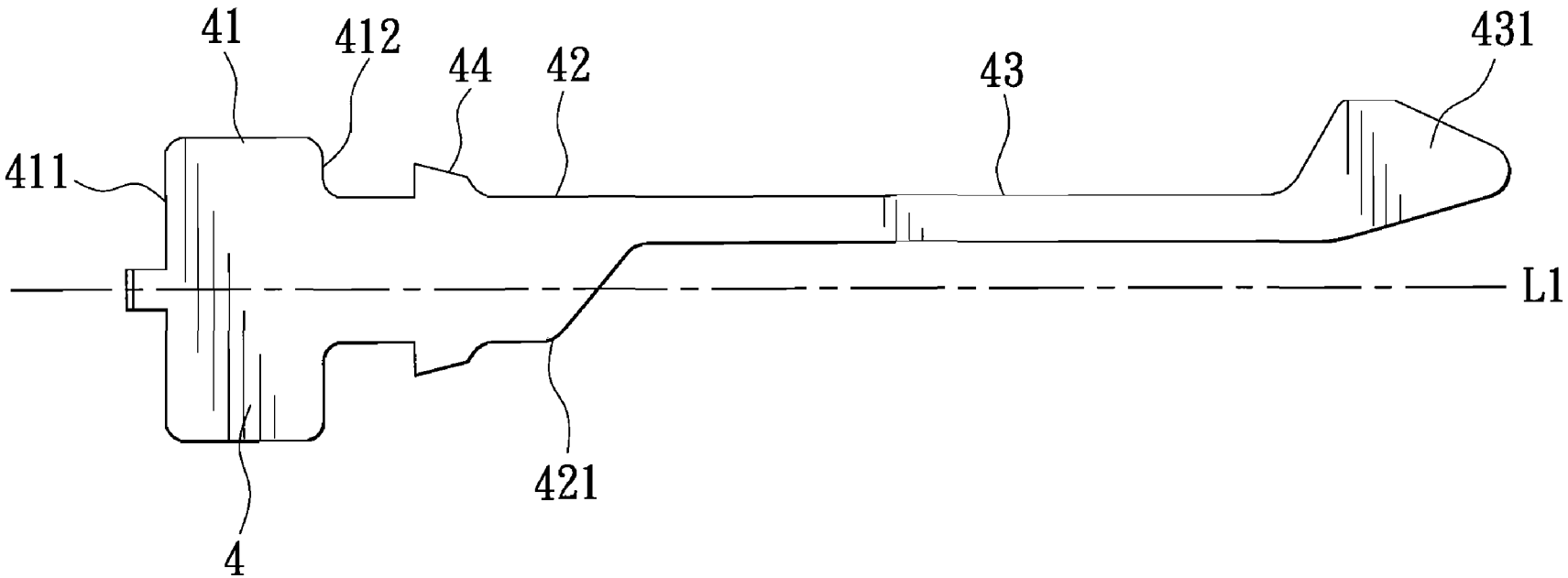
FIG. 9 is a side view of the receptacle engaging latch.

The contact projection 317, 337 of each of the first and third terminals 31, 33 projects in the same direction as the inspection segment 311, 331 of said one of the first and third terminals 31, 33 (see FIGS. 5 and 6). The contact projection 327 of each of the second terminals 32 projects in a direction opposite to that in which the inspection segment 321 of said one of the second terminals 32 extends (see FIG. 7). Each of the first, second, and third terminals 31, 32, 33 has a longitudinal segment length (D1, D2, D3) in a direction parallel to the first axis (L1) and measured from the inspection surface 318, 328, 338 of the inspection segment 311, 321, 331 to the contact projection 317, 327, 337. The soldering segment 312, 322, 332 of each of the first, second, and third terminals 31, 32, 33 has a soldering segment length (S1, S2, S3) in a direction parallel to the first axis (L1). In this embodiment, the longitudinal segment length (D2) is equal to the longitudinal segment length (D3) but is shorter than the longitudinal segment length (D1). Moreover, the soldering segment length (S1) is equal to the soldering segment length (S2) but is shorter than the soldering segment length (S3). It should be noted that the soldering segment lengths (S1, S2) may be longer than the soldering segment length (S3) in other embodiments of this invention. In this embodiment, each of the first terminals 31 of the terminal unit 3 is a power terminal, and each of the second and third terminals 32, 33 of the terminal unit 3 is a signal terminal.

The terminal spaces 13 in the terminal seat 1 are disposed for receiving respectively the first, second, and third terminals 31, 32, 33 of the terminal unit 3. Referring to FIG. 10, each of the terminal spaces 13 has a first groove portion 131 formed in the positioning section 11 of the terminal seat 1 for retaining the soldering segment 312, 322, 332 of the respective one of the first, second, and third terminals 31, 32, 33 therein, a second groove portion 132 in spatial communication with the first groove portion 131 for receiving the inspection segment 311, 321, 331 of the respective one of the first, second, and third terminals 31, 32, 33, a first hole portion 133 extending from the second groove portion 132 parallel to the first axis (L1) through the positioning section 11 for receiving the extending section 313, 323, 333 of the extending segment 310, 320, 330 of the respective one of the first, second, and third terminals 31, 32, 33, and a second hole portion 134 extending from the first hole portion 133 parallel to the first axis (L1) for extension of the resilient section 314, 324, 334 of the extending segment 310, 320, 330 of the respective one of the first, second, and third terminals 31, 32, 33. Referring to FIG. 2, in this embodiment, the first groove portions 131 of some of the terminal spaces 13 that retain respectively the soldering segments 312, 332 of the first and third terminals 31, 33 are formed in the first surface 113 of the positioning section 11, while the first groove portions 131 of other ones of the terminal spaces 13 that retain respectively the soldering segments 322 of the second terminals 32 are formed in the second surface 114 of the positioning section 11. In this embodiment, the first groove portion 131 of one of the terminal spaces 13 for retaining the soldering segment 332 of the third terminal 33 has a length equal to the soldering segment length (S3) of the soldering segment 332, while the first groove portion 131 of other ones of the terminal spaces 13 has a length equal to the soldering segment length (S1) of the soldering segment 312 of the first terminal 31. A largest dimension of the seat engaging portion 316, 326, 336 of each of the first, second, and third terminals 31, 32, 33 in a direction parallel to the second axis (L2) is slightly larger than a diameter of the first hole portion 133 of the respective one of the terminal spaces 13, while a largest dimension of the guide portion 315, 325, 335 of each of the first, second, and third terminals 31, 32, 33 in the direction parallel to the second axis (L2) is slightly smaller than the diameter of the first hole portion 113 of the respective one of the terminal spaces 13.

As shown in FIGS. 3, 8, 9 and 13, the receptacle engaging latches 4 are spaced apart from each other along the third axis (L3) and flank the first, second and third terminals 31, 32, 33 of the terminal unit 3. Each of the receptacle engaging latches 4 is disposed in the terminal seat 1, extends parallel to the first axis (L1) and has an inspection section 41, a seat engaging section 42, and a resilient latch section 43. The inspection section 41 is formed with a side surface 411 and a stop surface 412 that is disposed opposite to the side surface 411 in the direction parallel to the first axis (L1). The seat engaging section 42 extends from the stop surface 412 of the inspection section 41 in the direction parallel to the first axis (L1), and is formed with an engaging portion 44 and a stepped guide surface 421 connected to the engaging portion 44. The resilient latch section 43 extends from the seat engaging section 42 in the direction parallel to the first axis (L1) and is formed with a positioning portion 431 that projects in the same direction as the contact projections 317, 327, 337 of the first, second, and third terminals 31, 32, 33. The engaging portion 44 tapers toward the resilient latch section 43.

Each of the latch holes 14 in the terminal seat 1 is disposed for receiving respectively the receptacle engaging latches 4, and has a large diameter hole portion 141 formed in the positioning section 11 for retaining the inspection section 41 of the respective one of the receptacle engaging latches 4, a small diameter hole portion 142 spaced apart from the large diameter hole portion 141 in the direction parallel to the first axis (L1) for receiving the resilient latch section 43 of the respective one of the receptacle engaging latches 4, and an intermediate hole portion 143 between the large diameter hole portion 141 and the small diameter hole portion 142 for receiving the seat engaging section 42 of the respective one of the receptacle engaging latches 4. The intermediate hole portion 143 has a diameter larger than that of the small diameter hole portion 142 and smaller than that of the large diameter hole portion 141. A largest dimension of the engaging portion 44 of the seat engaging section 42 of each of the receptacle engaging latches 4 in a direction parallel to the second axis (L2) is slightly larger than a diameter of the intermediate hole portion 143 of the respective one of the latch holes 14.

Figure 13:
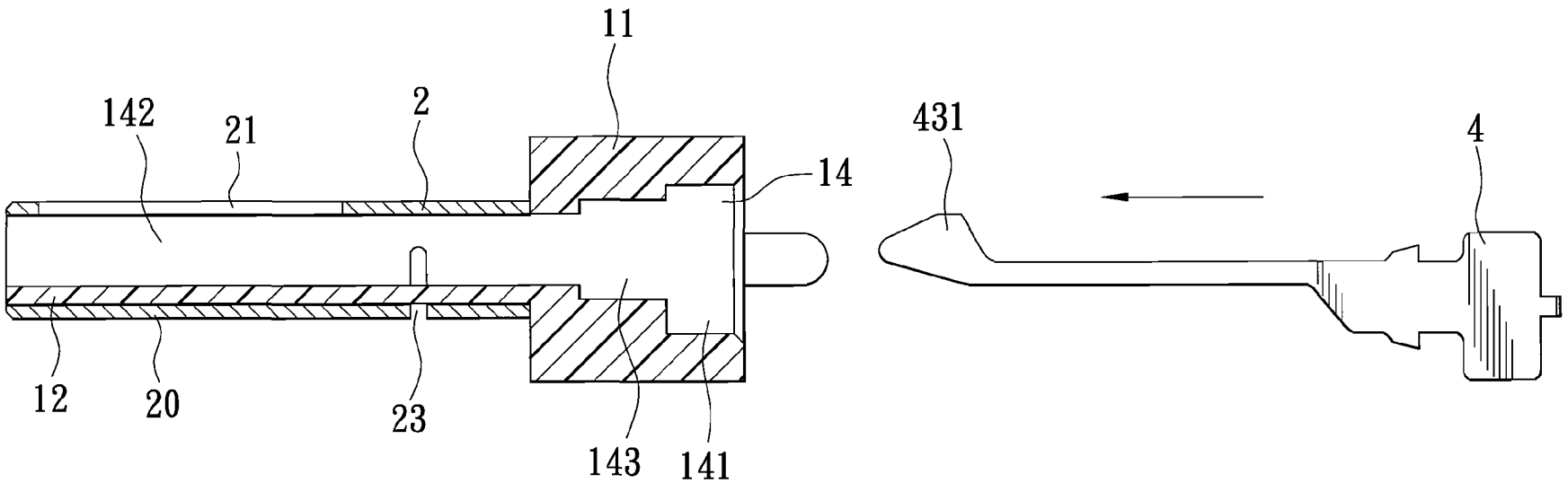
FIG. 13 is a sectional view of the preferred embodiment, illustrating the receptacle engaging latch before being extended into the terminal seat.
Figure 14:
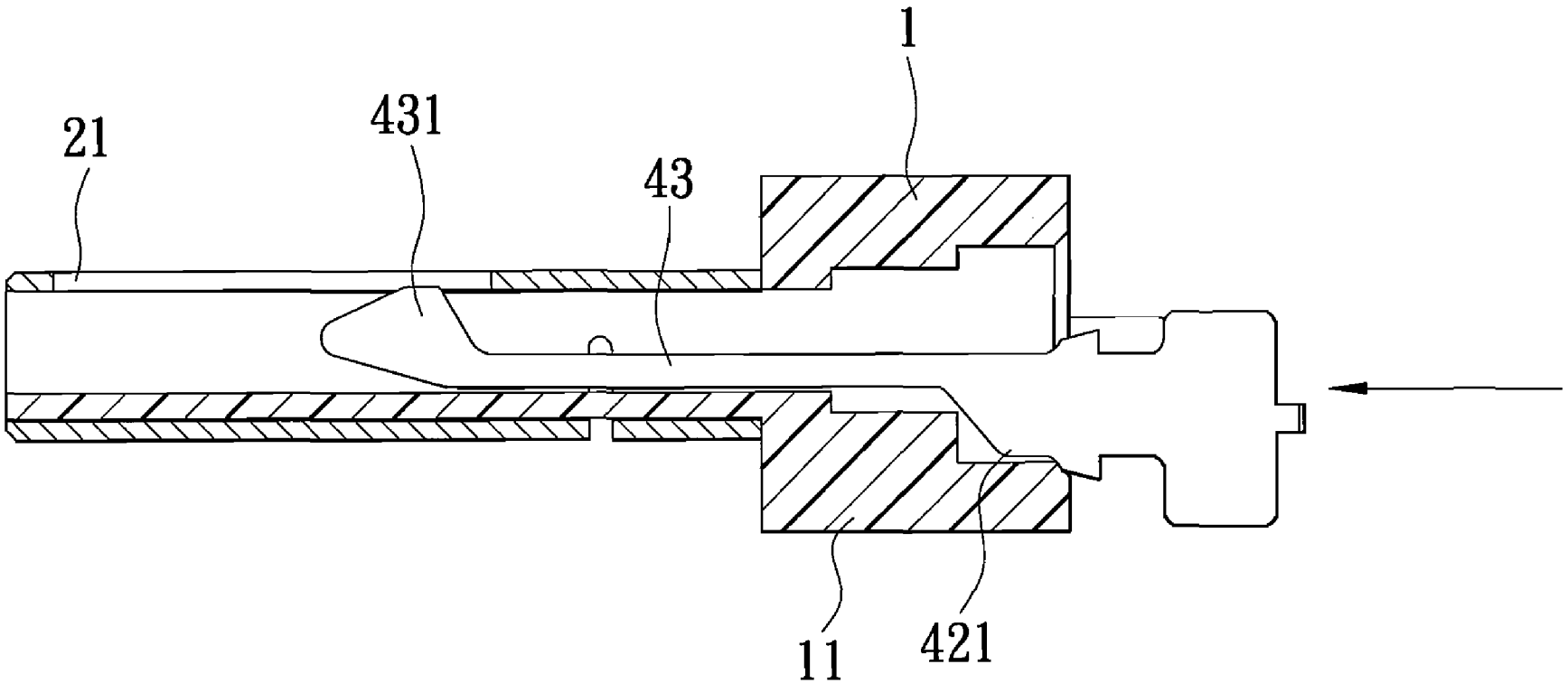
FIG. 14 is another sectional view of the preferred embodiment, illustrating the receptacle engaging latch when being extended into the terminal seat with a guide surface abutting against a positioning section of the terminal seat.
Figure 15:
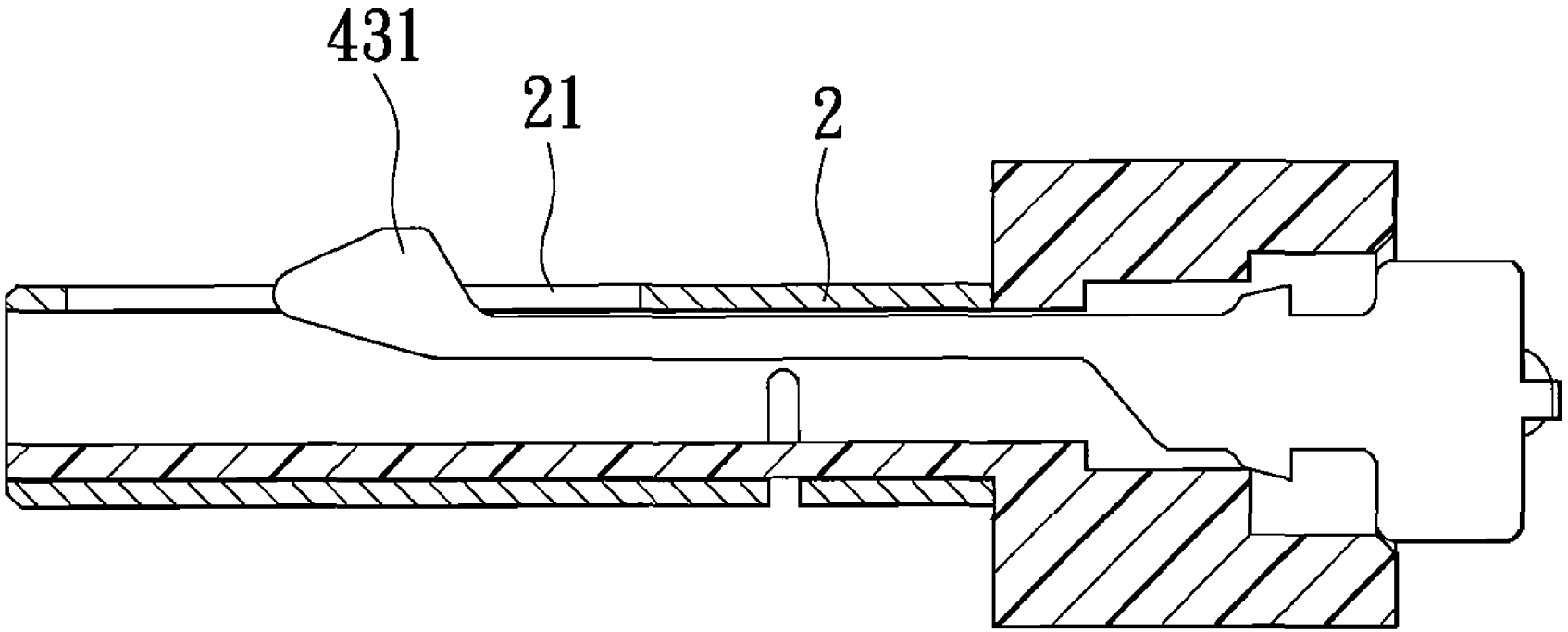
FIG. 15 is a view similar to FIG. 14, but illustrating the receptacle engaging latch when being extended into the terminal seat with a positioning portion retained in a first slit in a housing.
Figure 16:
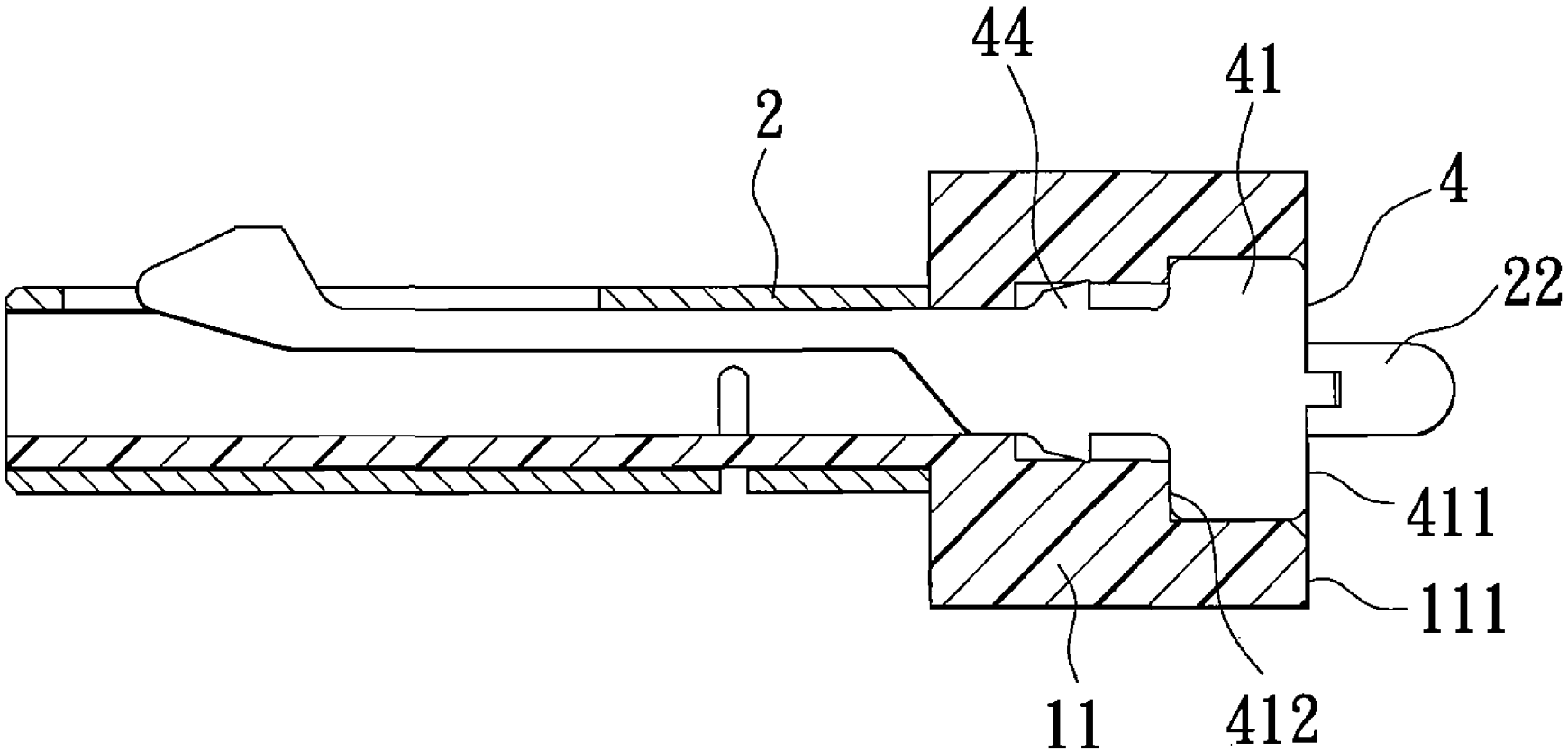
FIG. 16 is a view similar to FIG. 14, but illustrating the receptacle engaging latch after being extended into the terminal seat.

Referring to FIGS. 2, 3 and 13, the housing 2 has a housing body 20 sleeved on the coupling section 12 of the terminal seat 1, and is formed with a pair of first slits 21 that are spaced apart in a direction parallel to the third axis (L3), and a second slit 23 that is formed in one side opposite to the first slits 21 in a direction parallel to the second axis (L2). Each of the first slits 21 is in spatial communication with the small diameter hole portion 142 of a respective one of the latch holes 14 to permit extension of the positioning portion 431 of the resilient latch section 43 of the respective one of the receptacle engaging latches 4 therethrough. The housing 2 further has a pair of anchor tabs 22 extending from the housing body 20.

When assembling the micro USB plug 10 of this invention, the housing 2 is first sleeved on the coupling section 12 of the terminal seat 1 with the anchor tabs 22 extending respectively through the anchor holes 15 in the terminal seat 1. Afterward, the first, second, and third terminals 31, 32, 33 of the terminal unit 3 and the receptacle engaging latches 4 are mounted in the terminal seat 1.

As shown in FIGS. 2, 10, 11, and 12, when mounting the third terminal 33 of the terminal unit 3, the terminal seat 1 is held stationary, and the third terminal 33 is moved toward the terminal seat 1 in a direction parallel to the first axis (L1) such that the resilient section 334 of the extending segment 330 and the guide portion 335 of the extending section 333 of the extending segment 330 extend respectively into the second hole portion 134 and the first hole portion 133 of the respective one of the terminal spaces 13 in the terminal seat 1. Then, the third terminal 33 is further moved in the same direction with the guide portion 335 of the extending section 333 of the extending segment 330 positioning the resilient section 334 in the second hole portion 134 until the abutting surface 339 of the inspection segment 331 abuts against the terminal seat 1. At this time, the soldering segment 332 is retained in the first groove portion 131 of the respective one of the terminal spaces 13, the inspection segment 331 is retained in the second groove portion 132 of the respective one of the terminal spaces 13 with the inspection surface 338 flush with the reference surface 111 of the positioning section 11, and the seat engaging portion 336 of the extending section 333 engages the positioning section 11 of the terminal seat 1. The first and second terminals 31, 32 are mounted in the terminal seat 1 in the same manner.

As shown in FIGS. 2, 13, 14, 15 and 16, when mounting one of the receptacle engaging latches 4, the terminal seat 1 is held stationary, and the receptacle engaging latch 4 is moved toward the terminal seat 1 in a direction parallel to the first axis (L1) such that the resilient latch section 43 extends into the respective one of the latch holes 14 in the terminal seat 1, and that the guide surface 421 of the seat engaging section 42 abuts against the positioning section 11 of the terminal seat 1. Then, the receptacle engaging latch 4 is further moved in the same direction so that the positioning portion 431 extends outwardly of the housing 2 via the respective one of the first slits 21 in the housing body 20 through guidance of the guide surface 421 until the stop surface 412 of the inspection section 41 abuts against the positioning section 11 of the terminal seat 1. At this time, the side surface 411 of the inspection section 41 is flush with the reference surface 111 of the positioning section 11 of the terminal seat 1, and the engaging portion 44 of the seat engaging section 42 engages the positioning section 11. The other one of the receptacle engaging latches 4 is mounted in the terminal seat 1 in the same manner.

Finally, the anchor tabs 22 of the housing 2 are bent to engage the reference surface 111 of the positioning section 11 of the terminal seat 1. The bending angle of the anchor tabs 22 can be adjusted so as to meet different engaging strength requirements between the housing 2 and the terminal seat 1. The assembled micro USB plug 10 can then be coupled to a plug boot 5 (see FIG. 1) via an injection molding process.

Since the soldering segments 312, 322, 332 of the first, second and third terminals 31, 32, 33 of the terminal unit 3 are retained separately and respectively in the first groove portions 131 of the terminal spaces 13 in the terminal seat 11, the soldering tin applied to one of the soldering segments 312, 322, 332 will not spill onto the adjacent one of the soldering segments 312, 322, 332 during the soldering process, thereby avoiding short circuits between adjacent ones of the terminals 31, 32, 33. In addition, the first and third terminals 31, 33 can be easily distinguished from each other by the difference between the soldering segment lengths (S1, S3), thereby avoiding incorrect mounting in the terminal spaces 13 in the terminal seat 1. Moreover, an operator can easily recognize that any one of the first, second and third terminals 31, 32, 33 is properly assembled to the terminal seat 1 by checking if the inspection surface 318, 328, 338 of the inspection segment 311, 321, 331 of said one of the first, second and third terminals 31, 32, 33 is flush with the reference surface 111 of the positioning section 11 of the terminal seat 1. Similarly, the operator can easily recognize that any one of the receptacle engaging latches 4 is properly assembled to the terminal seat 1 by checking if the side surface 411 of the inspection section 41 of said one of the receptacle engaging latches 4 is flush with the reference surface 111. Furthermore, during the injection molding process, a portion of plastic material is injected into the second slit 23 in the housing body 20 of the housing 2, thereby preventing separation of the housing 2 from the plug boot 5 during use of the micro USB plug 10 of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A micro USB plug comprising:

a terminal seat having a reference surface; and a terminal unit including two first terminals, two second terminals, and a third terminal, each of which extends into said terminal seat parallel to a first axis that is normal to said reference surface and has an extending segment that extends parallel to the first axis and that has one end formed with a contact projection, an inspection segment that is connected to the other end of said extending segment opposite to said one end, that extends parallel to a second axis transverse to the first axis, and that has an inspection surface flush with said reference surface of said terminal seat, an abutting surface opposite to said inspection surface in a direction parallel to the first axis and abutting against said terminal seat, and a distal end spaced apart from said extending segment in a direction parallel to the second axis, and a soldering segment that extends from said distal end of said inspection segment parallel to the first axis and toward said one end of said extending segment, and that has a segment length;

wherein said contact projection of each of said first and third terminals projects in the same direction as said inspection segment of said one of said first and third terminals;

wherein said contact projection of each of said second terminals projects in a direction opposite to that in which said inspection segment of said one of said second terminals extends; and wherein the segment length of said soldering segment of each of said first terminals is not equal to that of said soldering segment of said third terminal.

2. The micro USB plug as claimed in claim 1, wherein the segment length of said soldering segment of each of said first terminals of said terminal unit is shorter than that of said soldering segment of said third terminal of said terminal unit.

3. The micro USB plug as claimed in claim 2, wherein the segment length of said soldering segment of each of said first terminals of said terminal unit is equal to that of said soldering segment of said second terminal of said terminal unit.

4. The micro USB plug as claimed in claim 1, wherein:

said second terminals of said terminal unit flank said third terminal of said terminal unit with respect to the first axis; and said first terminals of said terminal unit flank said second terminals and said third terminal with respect to the first axis.

5. The micro USB plug as claimed in claim 4, wherein:

each of said first terminals of said terminal unit is a power terminal; and each of said second and third terminals of said terminal unit is a signal terminal.

6. The micro USB plug as claimed in claim 1, wherein said extending segment of each of said first, second, and third terminals of said terminal unit has an extending section connected to said inspection segment, and a resilient section extending from one end of said extending section opposite to said inspection segment and formed with said contact projection, said extending section being formed with a seat engaging portion for engaging said terminal seat.

7. The micro USB plug as claimed in claim 6, wherein said seat engaging portion of said extending section of said extending segment of each of said first, second, and third terminals of said terminal unit tapers toward said resilient section.

8. The micro USB plug as claimed in claim 6, wherein said terminal seat has a positioning section formed with said reference surface and an end surface that is disposed opposite to said reference surface with respect to the first axis, a coupling section extending parallel to the first axis from said end surface of said positioning section, a plurality of terminal spaces spaced apart from each other along a third axis that is transverse to the first and second axes for receiving respectively said first, second and third terminals of said terminal unit, each of said terminal spaces having a first groove portion formed in said positioning section for retaining said soldering segment of the respective one of said first, second, and third terminals therein, a second groove portion in spatial communication with said first groove portion for receiving said inspection segment of the respective one of said first, second, and third terminals, a first hole portion extending from said second groove portion parallel to the first axis through said positioning section for receiving said extending section of said extending segment of the respective one of said first, second, and third terminals, and a second hole portion extending from said first hole portion parallel to the first axis for extension of said resilient section of said extending segment of the respective one of said first, second, and third terminals.

9. The micro USB plug as claimed in claim 8, wherein:

said positioning section of said terminal seat has opposite first and second surfaces extending from said reference surface to said end surface in a direction parallel to the first axis;

said first groove portions of some of said terminal spaces in said terminal seat that retain respectively said soldering segments of said first and third terminals of said terminal unit being formed in said first surface of said positioning section; and said first groove portions of other ones of said terminal spaces in said terminal seat that retain respectively said soldering segments of said second terminals being formed in said second surface of said positioning section.

10. The micro USB plug as claimed in claim 8, wherein said extending section of said extending segment of each of said first, second, and third terminals of said terminal seat is further formed with a guide portion between said seat engaging portion and said resilient section for positioning said resilient section in the respective one of said terminal spaces in said terminal seat.

11. The micro USB plug as claimed in claim 10, wherein said guide portion of said extending section of said extending segment of each of said first, second, and third terminals of said terminal unit tapers toward said resilient section.

12. The micro USB plug as claimed in claim 11, wherein:

said seat engaging portion of said extending section of said extending segment of each of said first, second, and third terminals of said terminal unit tapers toward said resilient section;

a largest dimension of said seat engaging portion of each of said first, second, and third terminals in a direction parallel to the second axis is slightly larger than a diameter of said first hole portion of the respective one of said terminal spaces in said terminal seat; and a largest dimension of said guide portion of each of said first, second, and third terminals in the direction parallel to the second axis is slightly smaller than the diameter of said first hole portion of the respective one of said terminal spaces in said terminal seat.

13. The micro USB plug as claimed in claim 8, further comprising a pair of receptacle engaging latches spaced apart from each other along the third axis and flanking said first, second and third terminals of said terminal unit, each of said receptacle engaging latches being disposed in said terminal seat, extending parallel to the first axis, and having an inspection section formed with a side surface that is flush with said reference surface of said terminal seat, and a stop surface that is disposed opposite to said side surface in the direction parallel to the first axis and that abuts against said terminal seat, a seat engaging section extending from said stop surface of said inspection section in the direction parallel to the first axis and formed with an engaging portion for engaging said terminal seat, and a resilient latch section extending from said seat engaging section in the direction parallel to the first axis, and formed with a positioning portion that projects in the same direction as said contact projections of said first, second, and third terminals of said terminal unit.

14. The micro USB plug as claimed in claim 13, wherein:

said terminal seat further has a pair of latch holes for receiving respectively said receptacle engaging latches, each of said latch holes having a large diameter hole portion formed in said positioning section for retaining said inspection section of the respective one of said receptacle engaging latches, a small diameter hole portion spaced apart from said large diameter hole portion in the direction parallel to the first axis for receiving said resilient latch section of the respective one of said receptacle engaging latches, and an intermediate hole portion between said large diameter hole portion and said small diameter hole portion for receiving said seat engaging section of the respective one of said receptacle engaging latches, and having a diameter larger than that of said small diameter hole portion and smaller than that of said large diameter hole portion.

15. The micro USB plug as claimed in claim 14, wherein:

said engaging portion of said seat engaging section of each of said receptacle engaging latches tapers toward said resilient latch section; and a largest dimension of said engaging portion of said seat engaging section of each of said receptacle engaging latches in a direction parallel to the second axis is slightly larger than a diameter of said intermediate hole portion of the respective one of said latch holes in said terminal seat.

16. The micro USB plug as claimed in claim 14, further comprising a housing having a housing body sleeved on said coupling section of said terminal seat and formed with a pair of first slits that are spaced apart in a direction parallel to the third axis, each of said first slits being in spatial communication with said small diameter hole portion of a respective one of said latch holes to permit extension of said positioning portion of said resilient latch section of the respective one of said receptacle engaging latches therethrough.

17. The micro USB plug as claimed in claim 15, wherein:

said positioning section of said terminal seat further has a pair of anchor holes extending parallel to the first axis from said reference surface through said end surface; and said housing further has a pair of anchor tabs, each of which extends from said housing body through a respective one of said anchor holes and is bent to engage said reference surface.

* * * * *